United States Patent [19]

Perez

[11] Patent Number: 4,959,918

[45] Date of Patent: Oct. 2, 1990

[54] SHELL CATCHER DEVICE

[76] Inventor: Kenneth M. Perez, 19427 Section Rd., Covington, La. 70433

[21] Appl. No.: 369,617

[22] Filed: Jun. 21, 1989

[51] Int. Cl.[5] ..... F41A 9/60

[52] U.S. Cl. ..... 42/98

[58] Field of Search ..... 42/98

[56] References Cited

U.S. PATENT DOCUMENTS

| | | | |
|---|---|---|---|
| 1,201,189 | 10/1916 | Johnson | 42/98 |
| 1,304,468 | 5/1919 | Fernandez | 42/98 |
| 2,866,289 | 12/1958 | Wilcox | 42/98 |
| 3,153,296 | 10/1964 | Hofstetter | 42/98 |
| 3,153,981 | 10/1964 | Brass | 42/98 |
| 4,028,834 | 6/1977 | Dobson | 42/98 |
| 4,110,927 | 9/1978 | Morris | 42/98 |
| 4,334,375 | 6/1982 | Olson | 42/98 |
| 4,430,820 | 2/1984 | Marsh | 42/98 |

*Primary Examiner*—Charles T. Jordan
*Assistant Examiner*—Michael J. Carone
*Attorney, Agent, or Firm*—Keaty & Keaty

[57] ABSTRACT

The invention relates to shell catcher devices for hand-held firearms which can be detachably mounted adjacent a chamber of the firearm from which the used shells are expelled. The device provides for the use of a flexible body carried by a rigid frame and a mounting bracket which allows the device to be mounted on the gun without scratching its surface. A protection cover extending over a shell receiving opening of the housing prevents the shells from travelling past the shell receiving opening.

6 Claims, 3 Drawing Sheets

SHELL CATCHER DEVICE

BACKGROUND OF THE INVENTION

The present invention relates to firearms, and more particularly to shell catchers attachable to guns.

It has long been a problem associated with hunting or skeet shooting, the amount of empty shells which are expelled from a shotgun or a rifle and which fall on the ground, sometimes in tall grass, and are either left in the grass by careless hunters or are retrieved by the hunter, in order to protect the environment and to remove the smell of empty shells from the pathway of a prey. Sometimes, especially while bird hunting, the hunter has to spend hours searching for the empty shells and retrieving them, while at the same time the hunter has to follow his prey and move continuously.

It is towards the solution of this problem that the present invention is directed.

SUMMARY OF THE INVENTION

The present invention provides for the use of a shell catcher device which is designed for attaching to a hand-held firearm, such as a shotgun or a rifle usually used by hunters, to the chamber of the firearm, so that the shell receiving opening of the device is in direct alignment with the opening of the chamber from which the shells are expelled.

The device of the present invention provides for the use of a collapsible housing which comprises a rectangularly shaped rigid frame and a flexible housing body attached about the periphery of the frame. The open top of the housing body receives the shells, while the closed bottom and peripheral wall retain the shells within the housing body. A suitable closure is formed in the wall of the housing body, so as to allow easy withdrawal of the shells collected in the housing.

Rigidly attached to the frame is a mounting means comprising a generally U-shaped bracket for mounting the device on the firearm. The bracket has an elongated plate, to opposite ends of which are perpendicularly attached vertical plates. One of the vertical plates carries a plastic suction cup with a concave surface of the cup facing towards the shell receiving opening of the housing body. The second vertical plate of the bracket carries a tightening screw which passes through an opening formed in the second plate to advance or to retract from the suction cup. One end of the screw carries a washer and a flexible, deformable pad, so as to prevent scratching of the valuable firearm by the mounting means. The second end of the screw carries a tightening nut, such as a wing or butterfly nut, so as to allow adjustment of the mounting bracket to various widths of the gun chambers.

In order to prevent shells from travelling past the shell receiving opening, a protection cover extends above and over the opening, the cover having its own rigid frame retaining the cover surfaces in the predetermined relationship to the shell receiving opening.

It is, therefore, an object of the present invention to provide a shell catcher device which is adapted for mounting on a hand-held firearm, such as a rifle or a shotgun, without adding any substantial weight to the firearm itself.

It is a further object of the present invention to provide a shell catcher device which is adapted for detachable mounting on the firearm adjacent to the chamber of the firearm.

It is a further object of the present invention to provide a shell catcher device having a shell receiving housing with a shell receiving opening and a shell retaining portion.

It is still a further object of the present invention to provide a shell catcher device having a protection cover for preventing the shells from travelling past the shell receiving opening.

These and other objects of the present invention will be apparent to those skilled in the art from the following description of the invention.

BRIEF DESCRIPTION OF THE DRAWINGS

Referring now to the drawings.

DETAILED DESCRIPTION OF THE PREFERRED EMBODIMENT

Figure 1:
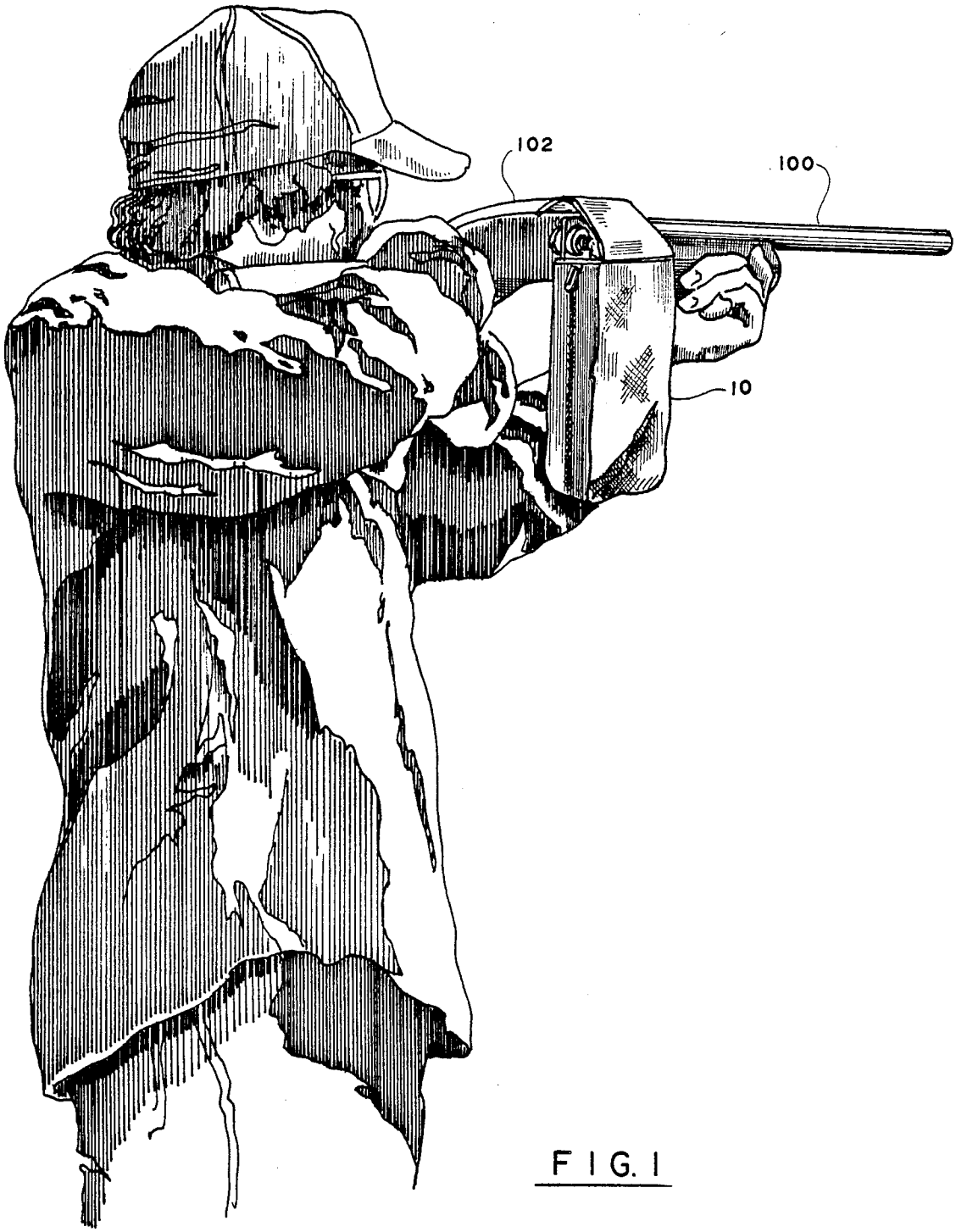
FIG. 1 illustrates the shell catcher device in accordance with the present invention as mounted on a chamber of a shotgun.
Figure 2:
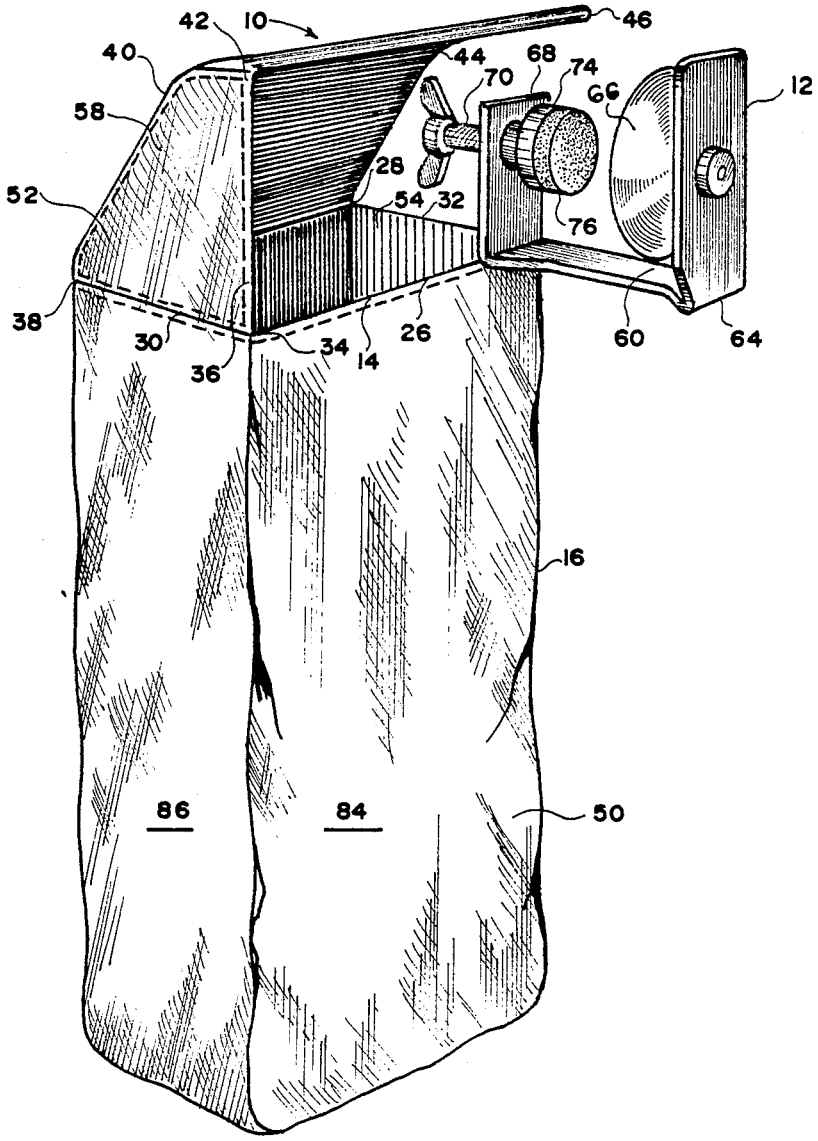
FIG. 2 is a perspective view of the device in accordance with the present invention; and, FIG. 3 is a perspective view of the shell catcher device of the present invention shown from the opposite side in relation to the view of FIG. 2.
Figure 3:
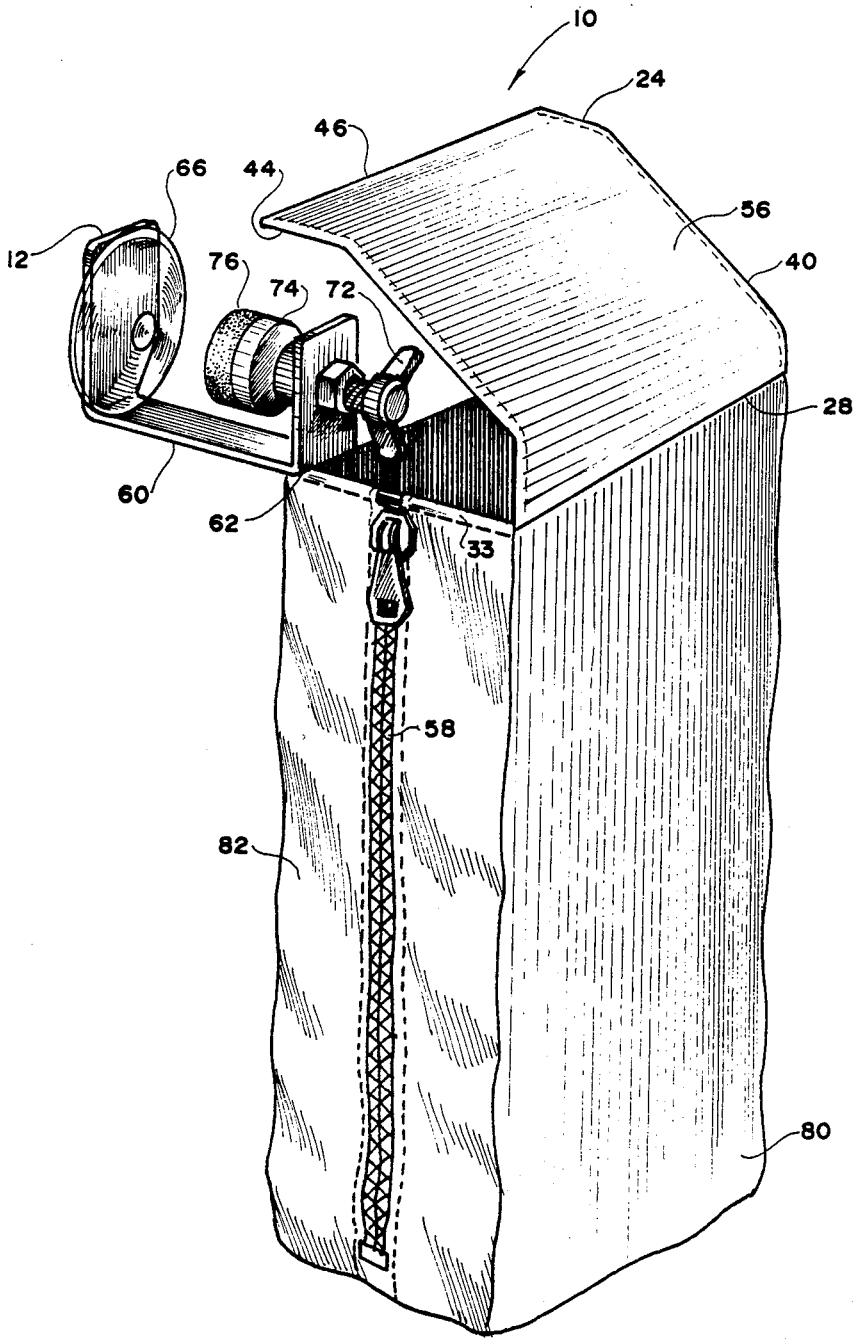

Referring to the drawings in more detail, and particularly FIGS. 2 and 3, the device of the present invention is designated by numeral 10 in the drawings. The device 10 comprises a means for mounting the device on a shotgun or a rifle designated by numeral 12 and a shell receiving housing means 16 having a housing frame 14.

The housing frame 14 is comprised of rectangularly shaped supporting frame which includes an inner supporting rod 26, an outer supporting rod 28 and a pair of connecting transverse rods 30 and 32 connecting the rods 26 and 28 in the generally rectangular configuration. Extending upwardly from the housing frame 14 is a protection cover frame 24, which has a vertical support rod 36 which extends substantially perpendicularly to the horizontal frame 24 at a corner wherein the rods 26 and 30 meet.

Extending from a laterally opposing corner 38 is a curved rod 40 which connects the corner 38 with an end 42 of the rod 36 opposite the corner 34. A similar rod 44 connects a corner 33, wherein rods 28 and 32 meet with one end of a horizontal rod 46 which extends in substantially parallel, vertically spaced apart relationship to the rod 26 and is connected at the corner 42 to the curved rod 40.

The frame means 14 thus forms a rigid support for a housing means 16. As can be seen in the drawings, the housing means 16 comprises a collapsible housing body 50 formed from a substantially flexible, collapsible material such as canvas or other fabric and is attached along the perimeter of the frame means 14 to define a shell receiving opening 54 at the top thereof. A protecting cover portion 52 is formed by stretching the fabric between the rods 36, 40, 44 and 46, so as to form an overhanging part 56 and one side wall 58.

The side opposite the side wall 58 is not closed, so as to allow easy access to the mounting means 12, as will be explained in more detail hereinafter.

The mounting means 12 comprise a generally U-shaped bracket means, having an elongated plate 60 which is fixedly attached to the rod 26 along substantially the same horizontal plane as the shell receiving opening 54, adjacent a corner 62 of the frame means 14.

Rigidly attached to one end of the plate 60 is a vertically extending plate 64 which carries a suction cup 66, with the concave surface of the cup 66 facing inwardly, towards the shell receiving opening 54.

Rigidly attached to the opposite end of the plate 60 is a vertically extending securing plate 68 which is attached in a substantially perpendicular relationship to the plate 60. An opening is formed in the plate 68 substantially coaxially with the central axis of the suction cup 66, the opening receiving a threaded screw 70 therethrough. One end of the screw 70 carries a tightening nut, such as a butterfly nut 72, while the second end of the screw 70 has a washer 74 fixedly attached to the screw or bolt 70. Fixedly attached to the washer 74 is a pad 76 formed from a flexible deformable material, such as rubber or rubber foam, the pad 76 facing the suction cup 66. The pad 76 prevents scratching of the gun surface, similar to the plastic suction cup 66. The screw 70 is adapted for lateral horizontal movement within the limits set by a nut 73 and by washer 74, so as to limit lateral movement of the screw 70 towards the suction cup 66 or away from it and prevent its disengagement from the plate 68.

The housing means 16 has an open top, closed bottom and a peripheral wall, which is formed of four rectangularly shaped panels 80, 82, 84 and 86. A suitable side closure is formed in the panel 82 (better seen in FIG. 3) in the form of a zipper 88 or a similar means as to allow easy withdrawal of shells from the housing body 50.

In operation, a hunter places the bracket 12 about the chamber 102 of a shotgun or a rifle 100, such that the suction cup 66 contacts one side of the chamber, while the pad 76 contacts the opposite side of the chamber. The screw 70 is then tightened by rotating the butterfly nut 72, so as to bring the pad 76 into close engagement with the shotgun and allow the suction cup to securely attach the mounting means 12 to the rifle 100.

Since one of the sides of the cover 52 is open, access to the tightening means is easy for the hunter. The opening between the rod 46 and the rod 26 is in direct alignment with an aperture in the shotgun chamber, be it on the side, bottom or top of the shotgun, so as to allow shells expelled by the gun to be delivered directly into the shell receiving means 16. After the hunt is over, the shells can be extracted from the housing body 50 by opening the closure 88 and manually removing the shells collected in the housing body 50.

The device 10 can be easily folded to reduce its space during transportation, since the bag 50 is formed from flexible material, with the only two portions which are not collapsible being the bracket 60 and the rigid frame. However, if desired, these parts can be also made collapsible.

Many modifications can be made in the design of the present invention without departing from the scope thereof. I, therefore, pray that my rights to the present invention be limited only by the scope of the appended claims.

I claim:

1. A shell catcher device for a hand-held firearm, comprising:

a collapsible shell receiving means, comprising a substantially rigid housing frame having a periphery which defines a shell receiving opening and a collapsible housing body which is fixedly attached to said housing frame for receiving and retaining shells expelled from the firearm; and a means for mounting said shell receiving means on the firearm, said mounting means comprising a generally U-shaped bracket securedly attached to said rigid housing frame, said bracket comprising an elongated plate extending outwardly from said rigid frame about a horizontal plane of the shell receiving opening, a first attachment plate carried by one end of said elongated plate, a second attachment plate carried by an opposite end of said elongated plate, said first and said second attachment plates extending substantially perpendicularly to said elongated plate, and wherein said first attachment plate carries a concave suction cup means with a concave surface facing said second attachment plate.

2. The device of claim 1, wherein said shell receiving means further comprises a protection cover means extending substantially above entire shell receiving opening so as to prevent shells expelled by the firearm to travel past the periphery of the housing frame.

3. The device of claim 2, wherein said protection cover means comprises a rigid cover frame fixedly attached to the housing frame and extending upwardly therefrom and a cover fixedly attached to said cover frame, said cover defining at least one cover surface stretching opposite said mounting means.

4. A shell catcher device for a hand-held firearm, comprising:

a collapsible shell receiving means, said shell receiving means comprising a substantially rigid housing frame having a periphery which defines a shell receiving opening and a collapsible housing body fixedly attached to said housing frame for receiving and retaining shells expelled from the firearm;

a means for mounting said shell receiving means on the firearm, comprising a generally U-shaped bracket securely attached to said rigid housing frame, said bracket comprising an elongated plate extending outwardly from said rigid frame about a horizontal plane of the shell receiving opening, a first attachment plate carried by one end of said elongated plate, a second attachment plate carried by one end of said elongated plate, said first and said second attachment plates extending substantially perpendicularly to said elongated plate, said first attachment plate carrying a concave suction cup means with a concave surface facing said second attachment plate and wherein said second attachment plate carries a tightening means which comprises a screw engaged for a limited lateral movement within an opening formed in the second attachment plate, a washer carried by one end of the screw, a deformable pad fixedly attached to the washer and a tightening nut carried by an opposite end of the screw.

5. A shell catcher device for a hand-held firearm, comprising:

a substantially rectangular rigid housing frame;

a collapsible housing fixedly secured to the frame about a periphery thereof, said housing having an open top which defines a shell receiving opening, a closed bottom and a peripheral wall, said wall being provided with a closure allowing withdrawal of shells from the housing;

a generally U-shaped bracket means for mounting said housing on the firearm; the bracket means having an elongated plate fixedly attached to said rigid housing frame and extending away from said shell receiving opening substantially about a horizontal plane of the shell receiving opening, said bracket means further comprising a pair of vertically extending plates, each attached to opposite ends of the elongated plate, a first vertical plate being provided with a suction cup having a concave surface which faces the shell receiving opening, a second vertical plate being provided with a tightening means for securedly detachably mounting the housing on the firearm, said tightening means comprising a threaded screw passing through an opening formed in the second plate, one end of the screw carrying a tightening nut and another end of the screw carrying a washer and a deformable flexible pad attached to the washer and adapted to contact exterior surface of the firearm;

a protection cover means extending substantially over entire shell receiving opening and attached to said housing frame opposite said bracket means so as to prevent shells expelled by the firearm to travel past the shell receiving opening.

6. The device of claim 5, wherein said housing is made from a flexible lightweight material.

* * * * *